United States Patent [19]

Richardson et al.

[11] 4,448,120

[45] * May 15, 1984

[54] CALLIGRAPHIC APPARATUS AND METHOD AND ENGRAVING TOOL FOR USE IN CONNECTION THEREWITH

[76] Inventors: William A. Richardson, 608 Snyder Ave.; Douglas A. Richardson, 27 Canterbury La., both of Berkeley Heights, N.J. 07922

[ * ] Notice: The portion of the term of this patent subsequent to Jan. 25, 2000 has been disclaimed.

[21] Appl. No.: 492,154

[22] Filed: May 10, 1983

Related U.S. Application Data

[63] Continuation of Ser. No. 275,390, Jun. 19, 1981, which is a continuation-in-part of Ser. No. 240,574, Mar. 4, 1981, abandoned.

[51] Int. Cl.[3] ..... B41F 1/07

[52] U.S. Cl. ..... 101/32; 33/25 D; 33/23 R

[58] Field of Search ..... 101/28-32; 33/18 R, 23 R, 23 B, 23 H, 23 K, 24 R, 25 R, 25 B, 32 C; 30/164.9, 164.8, 168-169, 366, 353; 125/41; 145/24, 25; 23/854, 855

[56] References Cited

U.S. PATENT DOCUMENTS 4,369,701 1/1983 Richardson et al. ..... 101/32

*Primary Examiner*—E. H. Eickholt

*Attorney, Agent, or Firm*—Lerner, David, Littenberg, Krumholz & Mentlik

[57] ABSTRACT

Disclosed herein are an attachment, method, and apparatus for producing calligraphic lettering. The attachment, method, and apparatus involve supporting a calligraphic lettering implement such that the lettering implement does not rotate relative to a workpiece to be lettered as the lettering implement is moved over the workpiece to form a desired letter, character, or symbol thereon. There is also disclosed an engraving tool which has a chisel-pointed, carbide steel tip.

12 Claims, 9 Drawing Figures

CALLIGRAPHIC APPARATUS AND METHOD AND ENGRAVING TOOL FOR USE IN CONNECTION THEREWITH

REFERENCE TO RELATED APPLICATION

This a file wrapper continuation of application Ser. No. 275,390, filed June 19, 1981, which is a continuation-in-part of application Ser. No. 240,574, filed Mar. 4, 1981, now abandoned.

FIELD OF THE INVENTION

The present invention relates to an engraving tool for producing calligrapic lettering. As used herein, the term "lettering" refers to, among other things, any written, engraved, or printed letter, character, symbol, or combinations thereof.

BACKGROUND OF THE INVENTION

Calligraphy is generally defined as the art of elegant writing wherein each letter, character, or symbol consists of a variable width line or lines. In the past, calligraphic writing has been produced manually using special writing tools, such as quills and chisel-pointed pens. These tools are special in that they must have the ability to produce a variable width line in a single stroke, the width of the line being independent upon the angular position of the tools relative to a workpiece to be lettered.

The manual production of calligraphic lettering requires a great amount of skill. Accordingly, it can take many years to become a skilled calligrapher. Also, even the skilled calligrapher must work relatively slowly in order to produce authentic calligraphic lettering. Thus, manual calligraphic lettering can be a time-consuming process even for the skilled calligraphers.

SUMMARY OF THE INVENTION

Many of the above-described problems and disadvantages associated with the manual production of calligraphic lettering are overcome by the present invention which involves new and improved tool adapted to facilitate the automatic or semi-automatic production of calligraphic lettering. In accordance with one aspect of the invention, the lettering implement or tool is provided with a chisel-pointed tip having an included angle in a range of from about 80° to about 120°. Perferably, the tip is made from solid carbide steel and has an included angle of 100°. By serrating the tip, it can be adapted to produce multiple-line callagraphic lettering, as compared with single-line or solid calligraphic lettering.

BRIEF DESCRIPTION OF THE DRAWINGS

For a more complete understanding of the present invention, reference may be had to the following description of various exemplary embodiments considered in connection with the figures of the accompanying drawings, in which.

DESCRIPTION OF AN EXEMPLARY EMBODIMENT

Figure 1A:
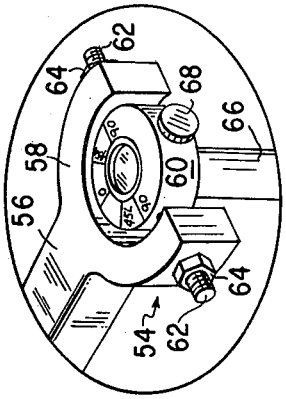
FIG. 1*a* is a detailed perspective view of a portion of the calligraphic attachment of FIG. 1.
Figure 1:
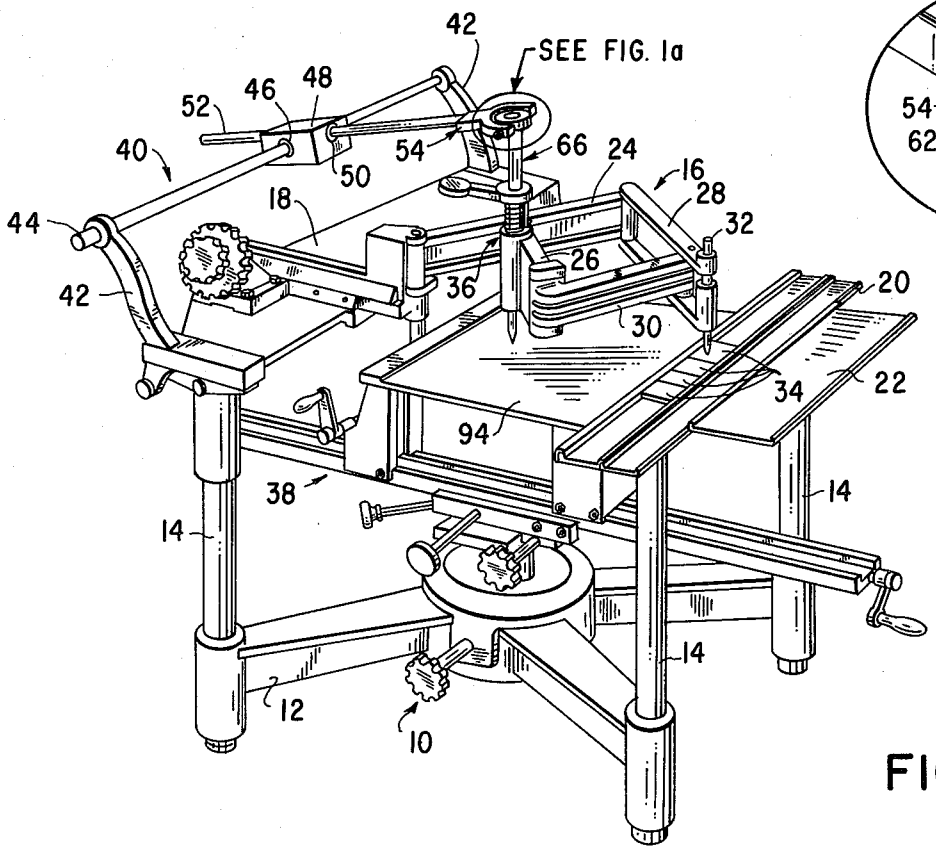
FIG. 1 is a perspective view of a conventional engraving machine which is retrofitted with a calligraphic attachment.

Referring to the drawings, a conventional jewelry engraving machine 10, such as a commercially available Hermes Model TX, GTX, ITFK or ITX, normally includes a base 12 which has four vertical posts 14 mounted thereon. The posts 14 support a pantographic mechanism 16, which is adjustably positioned on a support member 18 extending between two of the posts 14. The other two posts 14 support a master copy type holder 20 which is mounted on a platform 22.

The pantographic mechanism 16 has a main support arm 24 which is pivotally mounted to the support member 18. The pantographic mechanism 16 also includes two legs 26, 28 which are pivotally attached to the main support arm 24. Another leg 30 is pivotally connected to the legs 26, 28. The main support arm 24 cooperates with the legs 26, 28, 30 to form a parallelogram.

The leg 28 carries a stylus 32, which is adapted to follow a guide groove (not shown) formed in master copy type 34 positioned in the master copy type holder 20. An engraving tool holder 36, which includes a depressable lever arm 37, is carried by the leg 26.

A vice-type clamping device 38 is positioned below the pantographic mechanism 16. The clamping device 38 is adapted to mount various objects, such as trophies, to be engraved by the engraving machine 10.

The engraving machine 10 is retrofitted with an attachment 40 including a pair of supporting brackets 42, 42, each of which is removably attached to the support member 18 of the engraving machine 10. A rail 44 extends horizontally between the support brackets 42, 42. The rail 44 extends through a lower linear bearing 46 in a carriage 48, which is mounted for sliding movement along the rail 44. An upper linear bearing 50 mounted in the carriage 48 slideably receives a control rod 52 which carries a spindle support assembly 54.

With particular reference to FIG. 1*a*, the spindle support assembly 54 includes a fork 56 having a yoke portion 58. A collar 60 is pivotally mounted within the yoke portion 58 of the fork 56 by two threaded mounting pins 62, 62, which are releasably locked to the yoke portion 58 of the fork 56 by lock nuts 64, 64. The collar 60 is provided with settings identified as 0,45R 45L and 90. These settings will be described in more detail hereinafter. A spindle assembly 66 extends through the collar 60 and is locked in place by a set screw 68, which extends radially through the collar 60.

Figure 2:
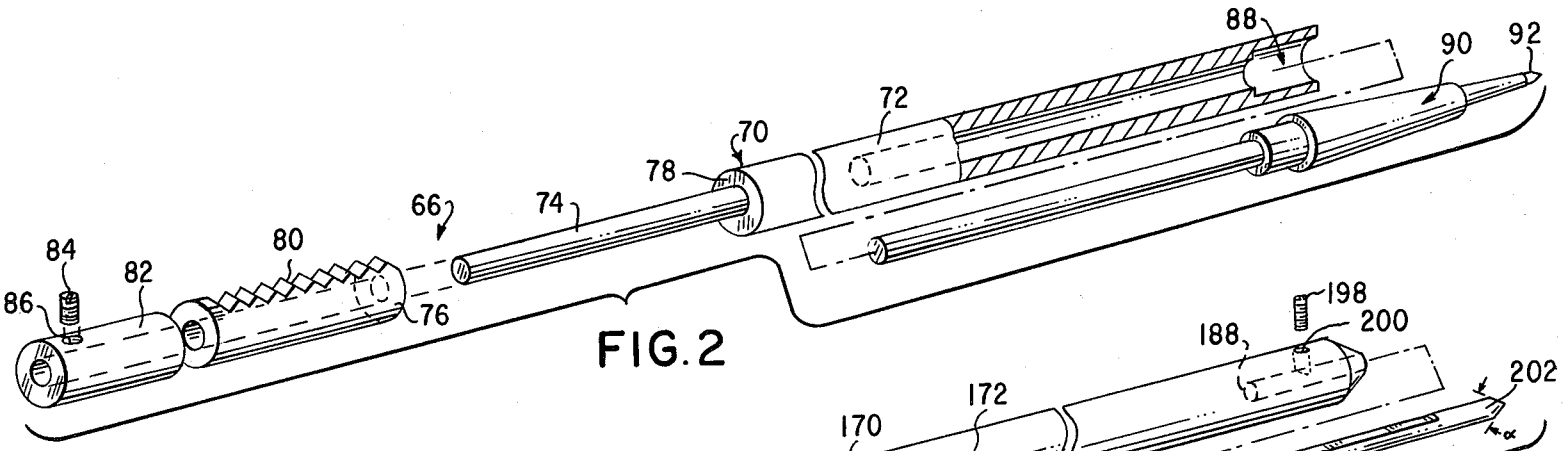
FIG. 2 is an exploded view of one embodiment of a spindle adapted for use in connection with the attachment shown in FIG. 1.

Referring now to FIG. 2, the spindle assembly 66 includes a holding member 70 having a large diameter portion 72 and a small diameter portion 74. A long sleeve 76 is slideably and rotatably positioned on the small diameter portion 74 of the holding member 70. The long sleeve 76 has an outer diameter which corresponds to the outer diameter of the large diameter portion 72 of the holding member 70 and an inner diameter which is slightly larger than the diameter of the small diameter portion 74 of the holding member 70. The long sleeve 76 is shorter than the small diameter portion 74 of the holding member 70 so that the small diameter portion 74 extends beyond the long sleeve 76 when the long sleeve 76 engages a shoulder 78 formed where the small diameter portion 74 meets the large diameter portion 72. A flat knurled surface 80 is formed on the long sleeve 76 for providing a gripping surface for a set screw (not shown) carried by the engraving tool holder 36 of the engraving machine 10. The small diameter portion 74 of the holding member 70 slideably and removably receives a short sleeve 82. The short sleeve 82 is locked in place on the small diameter portion 74 by a set screw 84 which extends through a threaded aperture 86 provided in the short sleeve 82. The large diameter portion 72 of the holding member 70 has a cavity 88, which is sized and shaped so as to removably but nonrotatably receive a cartridge and tip portion 90 of an art pen, such as the one made and sold by Everhard Faber, Inc., having a chisel-pointed tip 92. Because the long sleeve 76 is fixedly attached to the engraving tool holder 36 of the engraving machine 10, the holding member 70, which rotatably receives the long sleeve 76, is rotatable relative to the engraving tool holder 36 and therefore the pantographic mechanism 16 of the engraving machine 10. The spindle support assembly 54, the support rod 52, and the carriage 48 cooperate to maintain a predetermined angular position of the holding member 70 and hence the chisel-pointed tip 92 relative to a workpiece held by the clamping device 38 of the engraving machine 10.

In operation, before or after attaching the support brackets 42, 42, the rail 44, the carriage 48, the control rod 52 and the spindle support assembly 54 to the engraving machine 10, the original engraving tool is removed from the engraving tool holder 36 and replaced by the spindle assembly 66. After attaching the spindle assembly 66 to the spindle support assembly 54, the master copy type 34 is positioned in the master copy type holder 20 of the engraving machine 10. The workpiece to be engraved or printed is then placed on a support plate 94, which is fixedly positioned by the clamping device 38 of the engraving machine 10. The support plate 94 is preferably made of steel, so that magnets may be employed to hold the workpiece to the support plate 94. Alternatively, the workpiece may be supported directly by the clamping device 38, without the aid of the support plate 94.

In order to achieve a desired calligraphic style of lettering, the holding member 70 is set at a desired setting, which represents the angular position of the holding member 70 and hence the chisel-pointed tip 92 relative to the workpiece. After the desired setting has been selected, the stylus 32 is inserted into the guide groove formed in the master copy type 34. The guide groove typically defines a single-line character, letter, or symbol. The lever arm 37 is depressed so that the chisel-pointed tip 92 contacts the workpiece. The stylus 32 is manually moved so that it follows the guide groove of the master copy type 34 to form the letter, character, or symbol defined thereby. The lettering style can be varied by changing the settings without changing the master copy type 34. For instance, a different style may be obtained by loosening the set screw 68 and rotating the holding member 70 to a new setting. The set screw 68 is then tightened to maintain the holding member 70 at the new setting.

Figure 4:
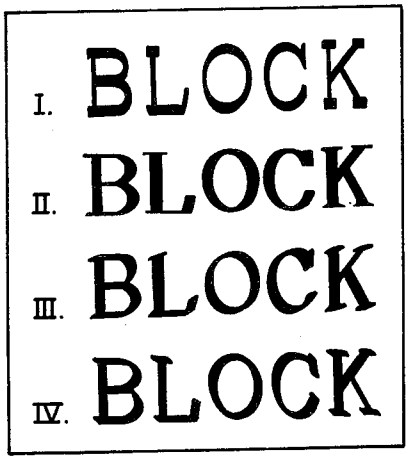
FIG. 4 is a plan view of a plate having the word "BLOCK" printed thereon and shown in four different calligraphic styles obtainable with the retrofitted apparatus of FIG. 1.

FIG. 4 shows four different styles of calligraphic lettering obtainable by equipping the engraving machine 10 with the attachment 40. All of these styles are obtainable by using the same single-line master copy type 34. More particularly, style I is produced when the spindle assembly 66 is set at the 0° setting, so that the chisel-pointed tip 92 creates a thin line when it is moved vertically and a thick line when it is moved horizontally, The spindle assembly 66 is set at the 90°setting for style II. The 90°setting causes the chisel-pointed tip 92 to create a thin line when it is moved horizontally and a thick line when it is moved vertically. Styles III and IV are produced by positioning the spindle assembly 66 at the 45° R and 45° L settings, respectively, whereby the chisel-pointed tip 92 makes a thin line when it is moved at a 45° angle and a thick line when it is moved at an opposite 45° angle. Other styles may, of course, be obtained simply by establishing additional settings.

Figure 3:
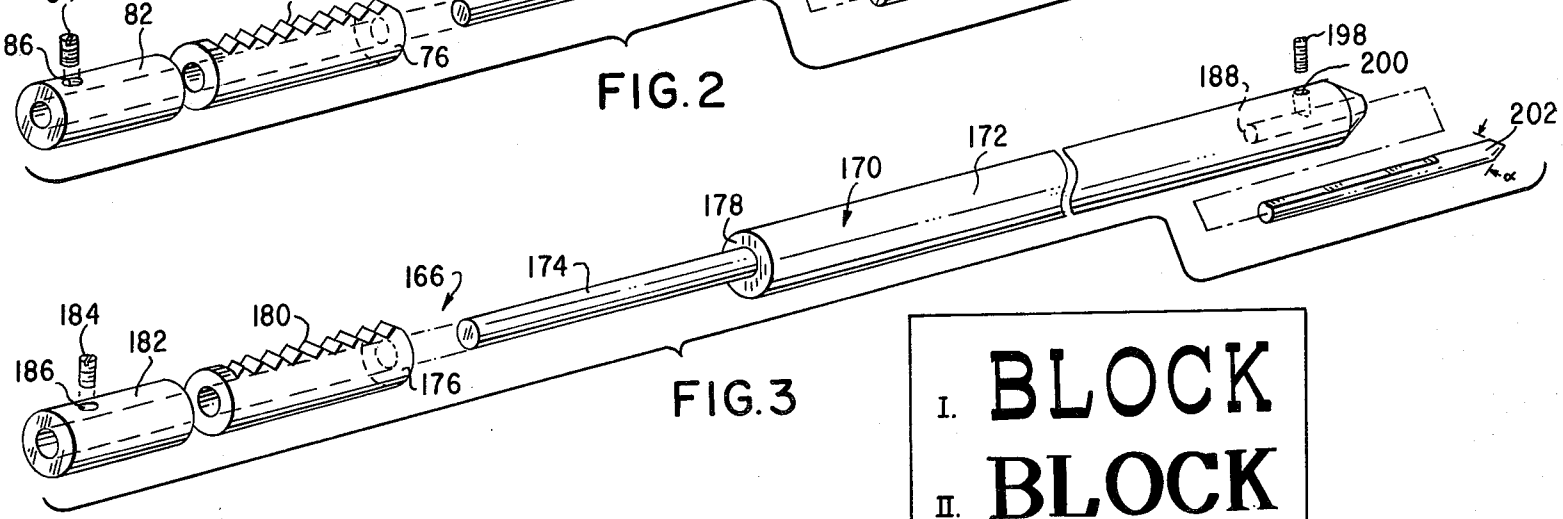
FIG. 3 is an exploded view of a second embodiment of a spindle equipped to receive an engraving tool constructed in accordance with the present invention and adapted for use in connection with the attachment illustrated in FIG. 1.

Another exemplary embodiment of the spindle assembly 66 is illustrated in FIG. 3. The various elements illustrated in FIG. 3 which correspond to elements described above in connection with the embodiment of FIG. 2 have been designated by corresponding reference numbers increased by 100. The embodiment of FIG. 3 operates in the same manner as the embodiment of FIG. 2, unless otherwise stated.

Referring now to FIG. 3, a holding member 170 is provided with a cavity 188 having a size and shape selected so as to releasably receive an engraving implement 196. A set screw 198, which is threadedly received in a hole 200 provided in a large diameter portion 172 of the holding member 170, prevents the engraving implement 196 from rotating relative to the holding member 170. The engraving implement 196 has an elongate, continuously straight chisel-pointed tip 202 having an included angle $\alpha$ which is in the range of from about 80° to about 120° and preferably about 100°. The engraving implement 196, including the chisel-pointed tip 202, is made from solid carbide steel. The chisel-pointed tip 202 is designed to produce the single-line or solid calligraphic lettering shown in FIG. 4.

Figure 5:
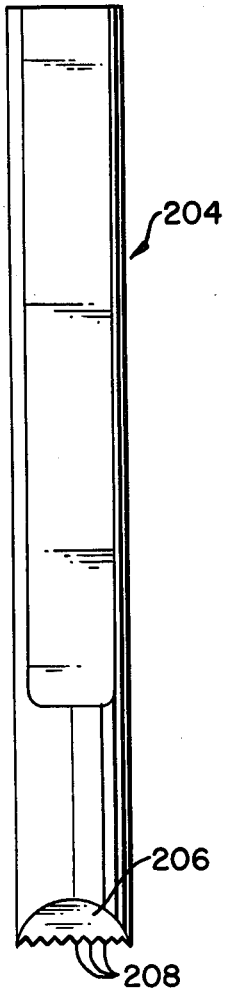
FIG. 5 is a front elevational view of a second embodiment of an engraving tool adapted to produce multiple-line calligraphic lettering in accordance with the present invention.
Figure 6:
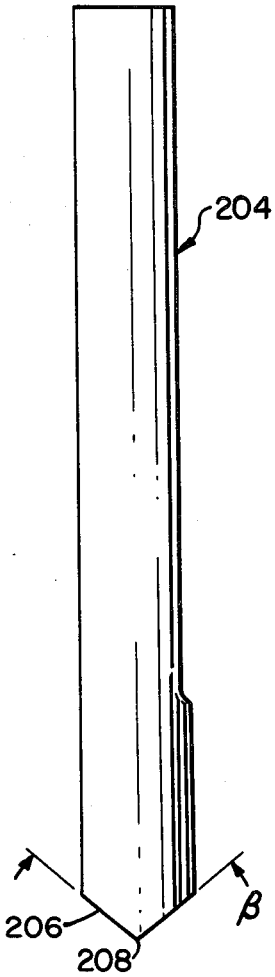
FIG. 6 is a side elevational view of the tool shown in FIG. 5.
Figure 7:
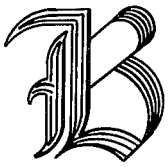
FIG. 7 is a sample of the type of lettering produced by the tool of FIGS. 5 and 6.

If it is desired to produce multiple-line calligraphic lettering, the engraving implement 196 can be replaced by an engraving implement 204, which is shown in FIGS. 5 and 6. The engraving implement 204 is basically the same as the engraving implement 196. For instance, the engraving implement 204 has a chisel-pointed tip 206 having an included angle $\beta$ in the same range as the chisel-pointed tip 202 of the engraving implement 196. However, in contrast to the engraving implement 196, the chisel-pointed tip 206 of the engraving implement 204 is provided with a plurality of serrations 208, each of which terminates in a point. By providing the chisel-pointed tip 206 with the pointed serrations 208, the engraving implement 204 is equipped to produce multiple-line calligraphic lettering, an example of which is illustrated in FIG. 7.

Figure 8:
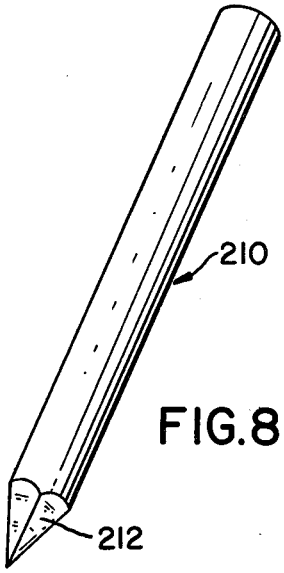
FIG. 8 is a perspective view of a noncalligraphic type engraving tool which may also be used in connection with the attachment of FIG. 1.

The attachment 40 is not limited to the production of calligraphic lettering, whether it be of the single-line variety or the multiple-line variety. With reference to FIG. 8, the attachment 40 may be equipped with an engraving implement 210 having a pyramid-shaped tip 212, which is designed to produce noncalligraphic lettering, such as conventional block lettering. The engraving element 210 is especially adapted to engrave coated metal surfaces, such as the black Cross pen now on the market.

It will be understood that the embodiment described herein is merely exemplary and that a person skilled in the art may make many variations and modifications without departing from the spirit and scope of the invention. For instance, the attachment 40 may be provided as original equipment on an engraving machine or a similar device. All such modifications and variations are intended to be included within the scope of the invention as defined in the appended claims.

What we claim is:

1. Calligraphic apparatus, comprising holding means for holding a workpiece to be lettered, lettering means for calligraphically lettering a workpiece held by said holding means, said lettering means including an engraving tool having an elongate, continuously straight chisel-pointed tip which has an included angle in a range of from about 80° to about 120°, positioning means for fixedly positioning single-line indicia relative to a workpiece held by said holding means, following means for following single-line indicia fixedly positioned by said positioning means, connecting means for connecting said lettering means to said following means such that the movement of said lettering means copies the movement of said following means, and attaching means for attaching said lettering means to said connecting means such that said lettering means continuously and automatically rotates relative to said connecting means without rotating relative to a workpiece held by said holding means during the movement of said lettering means as it copies the movement of said following means, whereby single-line indicia fixedly positioned by said positioning means may be used to produce single-line calligraphic lettering on a workpiece held by said holding means.

2. Calligraphic apparatus according to claim 1, wherein said tip is made from solid carbide steel.

3. Calligraphic apparatus according to claim 1, wherein said included angle is about 100°.

4. Calligraphic apparatus, comprising holding means for holding a workpiece to be lettered, lettering means for calligraphically lettering a workpiece held by said holding means, said lettering means including an engraving tool having a chisel-pointed tip which has an included angle in a range of from about 80° to about 120° and a plurality of serrations, each of which terminates in a point, positioning means for fixedly positioning single-line indicia relative to a workpiece held by said holding means, following means for following single-line indicia fixedly positioned by said positioning means, connecting means for connecting said lettering means to said following means such that the movement of said lettering means copies the movement of said following means, and attaching means for attaching said lettering means to said connecting means such that said lettering means continuously and automatically rotates relative to said connecting means without rotating relative to a workpiece held by said holding means during the movement of said lettering means as it copies the movement of said following means, whereby single-line indicia fixedly positioned by said positioning means may be used to produce multiple-line calligraphic lettering on a workpiece held by said holding means.

5. Calligraphic apparatus according to claim 4, wherein said tip is made from solid carbide steel.

6. Calligraphic apparatus according to claim 4, wherein said include angle is about 100°.

7. A method of producing calligraphic lettering employing apparatus including holding means for holding a workpiece to be lettered, lettering means for lettering a workpiece held by said holding means, said lettering means including and engraving tool having an elongate, continuously straight chisel-pointed tip which has an included angle in a range of from about 80° to about 120°, positioning means for fixedly positioning single-line indicia relative to a workpiece held by said holding means, following means for following single-line indicia fixedly positioned by said positioning means, and connecting means for connecting said lettering means to said following means such that the movement of said lettering means copies the movement of said following means, said method comprising the step of attaching said engraving tool to said connecting means such that said engraving tool continuously and automatically rotates relative to said connecting means without rotating relative to a workpiece held by said holding means during the movement of said engraving tool as it copies the movement of said following means, whereby single-line indicia fixedly positioned by said positioning means may be used to produce single-line calligraphic lettering on a workpiece held by said holding means.

8. A method of producing calligraphic lettering according to claim 7, wherein said tip is made from solid carbide steel.

9. A method of producing calligraphic lettering according to claim 7, wherein said included angle is about 100°.

10. A method of producing calligraphic lettering employing apparatus including holding means for holding a workpiece to be lettered, lettering means for lettering a workpiece held by said holding means, said lettering means including an engraving tool having a chisel-pointed tip which has an included angle in a range of from about 80° to about 120° and a plurality of serrations, each of which terminates in a point, positioning means for fixedly positioning single-line indicia relative to a workpiece held by said holding means, following means for following single-line indicia fixedly positioned by said positioning means, and connecting means for connecting said lettering means to said following means such that the movement of said lettering means copies the movement of said following means, said method comprising the step of attaching said engraving tool to said connecting means such that said engraving tool continuously and automatically rotates relative to said connecting means without rotating relative to a workpiece held by said holding means during the movement of said engraving tool as it copies the movement of said following means, whereby single-line indicia fixedly positioned by said positioning means may be used to produce multiple-line calligraphic lettering on a workpiece held by said holding means.

11. A method of producing calligraphic lettering according to claim 10, wherein said tip is made from solid carbide steel.

12. A method of producing calligraphic lettering according to claim 10, wherein said included angle is about 100°.

* * * * *